US009427966B2

(12) United States Patent
Matsuda

(10) Patent No.: US 9,427,966 B2
(45) Date of Patent: Aug. 30, 2016

(54) INKJET HEAD, METHOD FOR MANUFACTURING SAME, AND INKJET PRINTER

(71) Applicant: KONICA MINOLTA, INC., Tokyo (JP)

(72) Inventor: Shinya Matsuda, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/770,379

(22) PCT Filed: Mar. 3, 2014

(86) PCT No.: PCT/JP2014/055302

§ 371 (c)(1),
(2) Date: Aug. 25, 2015

(87) PCT Pub. No.: WO2014/141925

PCT Pub. Date: Sep. 18, 2014

(65) Prior Publication Data

US 2016/0009091 A1 Jan. 14, 2016

(30) Foreign Application Priority Data

Mar. 15, 2013 (JP) ..... 2013-053097

(51) Int. Cl.
*B41J 2/14* (2006.01)
*B41J 2/16* (2006.01)
*B41J 1/00* (2006.01)

(52) U.S. Cl.
CPC ..... *B41J 2/14233* (2013.01); *B41J 2/161* (2013.01); *B41J 2/1628* (2013.01); *B41J 2/1631* (2013.01); *B41J 2/1645* (2013.01); *B41J 2002/14241* (2013.01)

(58) Field of Classification Search
CPC ..... B41J 2/161; B41J 2/1626; B41J 2/1643; B41J 2002/14233; B41J 2002/14241; B41J 2002/14419; B41J 2002/14491; Y10T 29/42; Y10T 29/49126; Y10T 29/49128; Y10T 29/49401
USPC ..... 347/68, 70, 71
See application file for complete search history.

(56) References Cited

U.S. PATENT DOCUMENTS 5,852,337 A 12/1998 Takeuchi et al.
5,988,799 A 11/1999 Abe et al.

(Continued)

FOREIGN PATENT DOCUMENTS

CN 1170990 A 1/1998
CN 1408549 A 4/2003

(Continued)

OTHER PUBLICATIONS

International Search Report and Written Opinion in International Application No. PCT/JP2014/055302 dated May 27, 2014, 4 pages.

(Continued)

*Primary Examiner* — Anh T. N. Vo
(74) *Attorney, Agent, or Firm* — Brinks, Gilson & Lione

(57) ABSTRACT

An inkjet head (10) includes a displacement film (17), a substrate (11), and an ink discharge portion (21). The displacement film (17) includes a piezoelectric thin film (14) as a driving film operable to expand and contract in a direction perpendicular to its thickness direction to cause curving deformation of the displacement film (17) in its thickness direction. The substrate (11) has a dug portion (11*a*) as a hole portion formed in its thickness direction, and supports the displacement film (17) such that the displacement film (17) covers the dug portion (11*a*). The ink discharge portion (21) has an ink chamber (21*a*) holding ink, and discharges the ink outside with pressure applied to the ink by the curving deformation of the displacement film (17). The ink discharge portion (21) is provided opposite to the dug portion (11*a*) of the substrate (11) with respect to the displacement film (17).

14 Claims, 8 Drawing Sheets

(56) References Cited

U.S. PATENT DOCUMENTS

| | | | | |
|---|---|---|---|---|
| 6,186,618 | B1 * | 2/2001 | Usui | B41J 2/14233 347/70 |
| 6,209,994 | B1 * | 4/2001 | Furuhata | B41J 2/14233 310/330 |
| 6,592,210 | B2 * | 7/2003 | Lin | B41J 2/161 347/68 |
| 6,616,270 | B1 * | 9/2003 | Miyata | B41J 2/14233 347/68 |
| 6,903,491 | B2 * | 6/2005 | Irie | H01L 41/098 310/328 |
| 7,341,332 | B2 * | 3/2008 | Jung | B41J 2/14 347/54 |
| 7,479,728 | B2 * | 1/2009 | Murai | B41J 2/14233 310/363 |
| 7,497,557 | B2 * | 3/2009 | Sugahara | B41J 2/055 347/68 |
| 7,872,402 | B2 * | 1/2011 | Kobayashi | B41J 2/14233 252/62.9 PZ |
| 2003/0043237 | A1 | 3/2003 | Lin et al. | |

FOREIGN PATENT DOCUMENTS

| | | | |
|---|---|---|---|
| JP | 09-085946 | A | 3/1997 |
| JP | 09-286102 | A | 11/1997 |
| JP | 11-026832 | A | 1/1999 |
| JP | 2000-280468 | A | 10/2000 |
| JP | 2003-118128 | A | 4/2003 |
| JP | 2005-169965 | A | 6/2005 |
| JP | 2007-21802 | A | 2/2007 |
| JP | 2007-021802 | A | 2/2007 |
| JP | 5013025 | B2 | 6/2012 |
| WO | WO 2012/039266 | A1 | 3/2012 |

OTHER PUBLICATIONS

Chinese Office Action and Search Report for corresponding Chinese Patent Application No. 2014800156431 dated Mar. 24, 2016 (8 pages).

* cited by examiner

INKJET HEAD, METHOD FOR MANUFACTURING SAME, AND INKJET PRINTER

The present U.S. patent application is a U.S. National Phase Application under 35 USC 371 of International Application PCT/JP2014/055302 filed on Mar. 3, 2014. This application claims a priority under the Paris Convention of Japanese patent application No. 2013-053097 filed on Mar. 15, 2013, the entirety of which is incorporated herein by reference.

This application claims a priority under the Paris Convention of Japanese patent application No. 2013-053097 filed on Mar. 15, 2013, the entirety of which is incorporated herein by reference.

TECHNICAL FIELD

The present invention relates to an inkjet head that discharges ink to outside itself, a method for producing the same, and an inkjet printer including the inkjet head.

BACKGROUND ART

There have conventionally been known inkjet printers that include an inkjet head having a plurality of channels that discharge ink. Such inkjet printers are capable of outputting a two-dimensional image onto a recording medium such as a sheet of paper, cloth, etc. by controlling discharging of ink while moving the inkjet head relatively with respect to the recording medium. Discharging of ink can be performed by using an actuator (a piezoelectric actuator, an electrostatic actuator, a thermal actuator, or the like), or by generating air bubbles in ink in a tube by means of heat. In particular, piezoelectric actuators have recently been widely used for their advantages of large output, modifiability, high responsiveness, adaptability to any type of ink, etc.

Piezoelectric actuators are classified into two types: one using a bulk-state piezoelectric body and the other using a thin-film piezoelectric body (piezoelectric thin film). The former type has a large output and thus is capable of discharging ink droplets of a large size, but it is large-sized and thus is high in cost unfortunately. In contrast, the latter type has a small output and thus is not capable of forming ink droplets of a large size, but is compact and thus is low in cost. Consequently, it can be said that forming an actuator with a piezoelectric thin film is suitable to realize high-resolution printers (which can be achieved with small ink droplets) at low cost.

Reference is now made to FIG. 8, which presents a plan view schematically showing a configuration of a conventional actuator 100 using a piezoelectric thin film, and a sectional view taken along line A-A' of the plan view and viewed in the direction indicated by the arrows. The actuator 100 is configured by stacking, on a substrate 101 having a pressure chamber 101*a*, an insulation layer 102, a lower electrode 103, a piezoelectric film 104 as a piezoelectric thin film, and an upper electrode 105 in this order. An upper wall 101*b* of the pressure chamber 101*a* in the substrate 101 constitutes a driven film operable to be displaced according as the piezoelectric film 104 expands and contracts.

Specifically, when a voltage is applied from a drive circuit 106 to the lower electrode 103 and the upper electrode 105 and the piezoelectric film 104 is caused to expand and contract in a direction perpendicular to its thickness direction (a direction parallel to a face of the substrate 101), curvature is generated in the driven film due to difference in length between the piezoelectric film 104 and the driven film, the curvature causing the driven film to be displaced (curved) in its thickness direction.

A configuration of a channel 200 including the actuator 100 shown in FIG. 8 is schematically shown in FIG. 9, which is a sectional view. As shown in the figure, an ink chamber is formed by closing a space (the pressure chamber 101*a*) in a lower portion of the actuator 100 with a nozzle plate 201. With ink held in the pressure chamber 101*a*, by making use of the above-described displacement of the driven film caused by the expansion and contraction of the piezoelectric film 104, it is possible to apply pressure to the ink held in the pressure chamber 101*a* to thereby discharge the ink as ink droplets through a nozzle hole 201*a* to outside the pressure chamber 101*a*. An inkjet head is formed by arranging a plurality of such piezoelectric actuators 100 (channels 200) in a lateral direction.

Piezoelectric bodies widely used in such piezoelectric actuators as described above are perovskite metal oxides such as $BaTiO_3$ and $Pb(Ti/Zr)O_3$ which is called PZT. As for actuators using, a piezoelectric thin film, the piezoelectric thin film is produced by forming on a substrate a film of PZT, for example. The PZT film can be formed by means of various methods, such as a sputtering method, a CVD (chemical vapor deposition) method, a sol-gel method, and the like. Incidentally, since it requires a high temperature to crystalize piezoelectric materials, Si substrates are often used as the substrate.

Performance indices of an inkjet head include droplet amount, injection speed, drive frequency, etc., and output and responsiveness of each actuator serve as factors that determine these indices. The output of an actuator depends on the applied voltage, the piezoelectric constant, and the volume of the piezoelectric body, while the responsiveness of an actuator depends on the weight, the stiffness, etc. of the actuator.

The drive frequency of a head is also affected by weight and elasticity of ink. Specifically, with a large-capacity pressure chamber (ink chamber), which holds ink of a large weight, the ink as a whole becomes more elastically deformed, as a result of which the responsiveness of the actuator is degraded. Accordingly, to improve the responsiveness of the actuator so as to improve (increase) the drive frequency of the head, it is necessary to reduce the capacity of the ink chamber.

Methods for reducing capacity of an ink chamber include the following two methods. One is to polish a substrate, on which a piezoelectric body is supported, to reduce the height of an ink chamber formed in the substrate. The other is to transfer onto a thin substrate, in which a small-capacity ink chamber is formed in advance, a piezoelectric film formed on another substrate, thereafter removing the another substrate. Although adopted for different purposes, polishing a substrate as in the former method is disclosed in Patent Literature 1, for example, and transferring a piezoelectric film as in the latter method is disclosed in Patent Literature 2, for example.

CITATION LIST

Patent Literature

Patent Literature 1: Japanese Patent No. 5013025 (claim 1, paragraph [0012], FIG. 1, etc.)

Patent Literature 2: Japanese Patent Application Publication No. 2005-169965 (claim 1, paragraph [0019], FIGS. 3(a) and (b))

SUMMARY OF INVENTION

Technical Problem

However, in the case of polishing a substrate to reduce the capacity of an ink chamber, there is a concern that the substrate may crack or break during the process (polishing), or may warp while a film is being formed or during the process, lowering the yield and degrading the performance as an actuator. On the other hand, the case of transferring a piezoelectric film onto a thin substrate suffers damage of the piezoelectric film occurring at the time of film transfer, degradation of performance due to the damage, and increase in cost resulting from the use of two substrates. Thus, it is desirable that an inkjet head be so configured as to allow the capacity of an ink chamber to be reduced without substrate polishing or film transfer.

The present invention has been made to solve the above problems, and its object is to provide an inkjet head capable of reducing the capacity of an ink chamber without performing substrate polishing or film transfer, to thereby improve the drive frequency of the head, a method for producing such an inkjet head, and an inkjet printer including such an inkjet head.

Solution to Problem

To achieve the above object, according to one aspect of the present invention, an inkjet head includes a displacement film that includes a driving film operable to expand and contract in a direction perpendicular to a thickness direction of the driving film, the displacement film being operable to undergo curving deformation in a thickness direction of the displacement film, a substrate that includes a hole portion formed therein in a thickness direction thereof and that supports the displacement film such that the displacement, film covers the hole portion so as to allow expansion and contraction of the driving film to cause the curving deformation of the displacement film in the thickness direction of the displacement film in an area of the displacement film corresponding to the hole portion, and an ink discharge portion that includes a ink chamber holding ink therein and that discharges the ink to outside the ink discharge portion by having pressure resulting from the curving deformation of the displacement film applied to the ink. Here, the ink discharge portion is disposed on a side opposite to the hole portion of the substrate with respect to the displacement film.

According to another aspect of the present invention, a method for producing an inkjet head includes the steps of forming a driving film at a substrate, forming a hole portion in the substrate on a side opposite to a side where the driving film is formed and supporting a displacement film including the driving film such that the displacement film covers the hole portion so as to allow expansion and contraction of the driving film in a direction perpendicular to a thickness direction of the driving film to cause curving deformation of the displacement film in a thickness direction of the displacement film in an area of the displacement film corresponding to the hole portion, and forming an ink discharge portion, through which ink held in the ink chamber is discharged to outside the ink chamber by the curving deformation of the displacement film, on a side opposite to the hole portion of the substrate with respect to the displacement film.

Advantageous Effects of Invention

An ink discharge portion is provided on a side opposite to a substrate (a hole portion) with respect to a displacement film, independently of the substrate, and this makes it possible to achieve a design for reducing the capacity of an ink chamber by working on the design of the ink discharge portion independently and regardless of the substrate. This helps improve the drive frequency of a head by reducing the capacity of an ink chamber without performing substrate polishing or film transfer.

DESCRIPTION OF EMBODIMENTS

Presented below is a description of an embodiment of the present invention with reference to the accompanying drawings.

[Configuration of Inkjet Printer]

Figure 1:
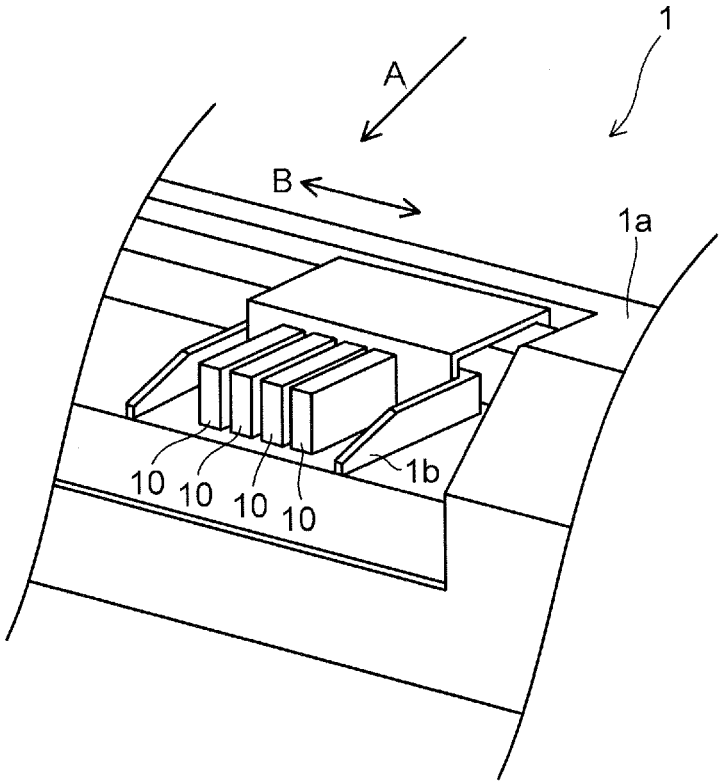
FIG. 1 is a perspective view showing part of an inkjet printer according to one embodiment of the present invention in an enlarged manner.

FIG. 1 is a perspective view showing part of an inkjet printer according to the present embodiment in an enlarged manner. An inkjet printer 1 includes a carriage 1*b* movable in a right-left direction (direction B in the figure) and disposed inside a cabinet 1*a* part of which is open. On the carriage 1*b*, a plurality of inkjet treads 10 are mounted in an array each corresponding to one of a plurality of colors (such as four colors of yellow, magenta, cyan, and black). The inkjet printer 1 is capable of forming a color image on a recording medium (unillustrated) by making the inkjet heads 10 discharge ink of each corresponding color while moving the carriage 1*b* in the right-left direction and conveying the recording medium frontward (in direction A in the figure) from a rear side.

The inkjet printer 1 may be configured such that the inkjet heads 10 are arranged all along a width direction of the recording medium, with a plurality of inkjet heads 10 for each color arranged in the recording medium conveyance direction. In this case, a color image can be formed on the recording medium while moving only the recording medium and keeping the inkjet heads 10 stationary.

[Configuration of Inkjet Head]

Figure 2:
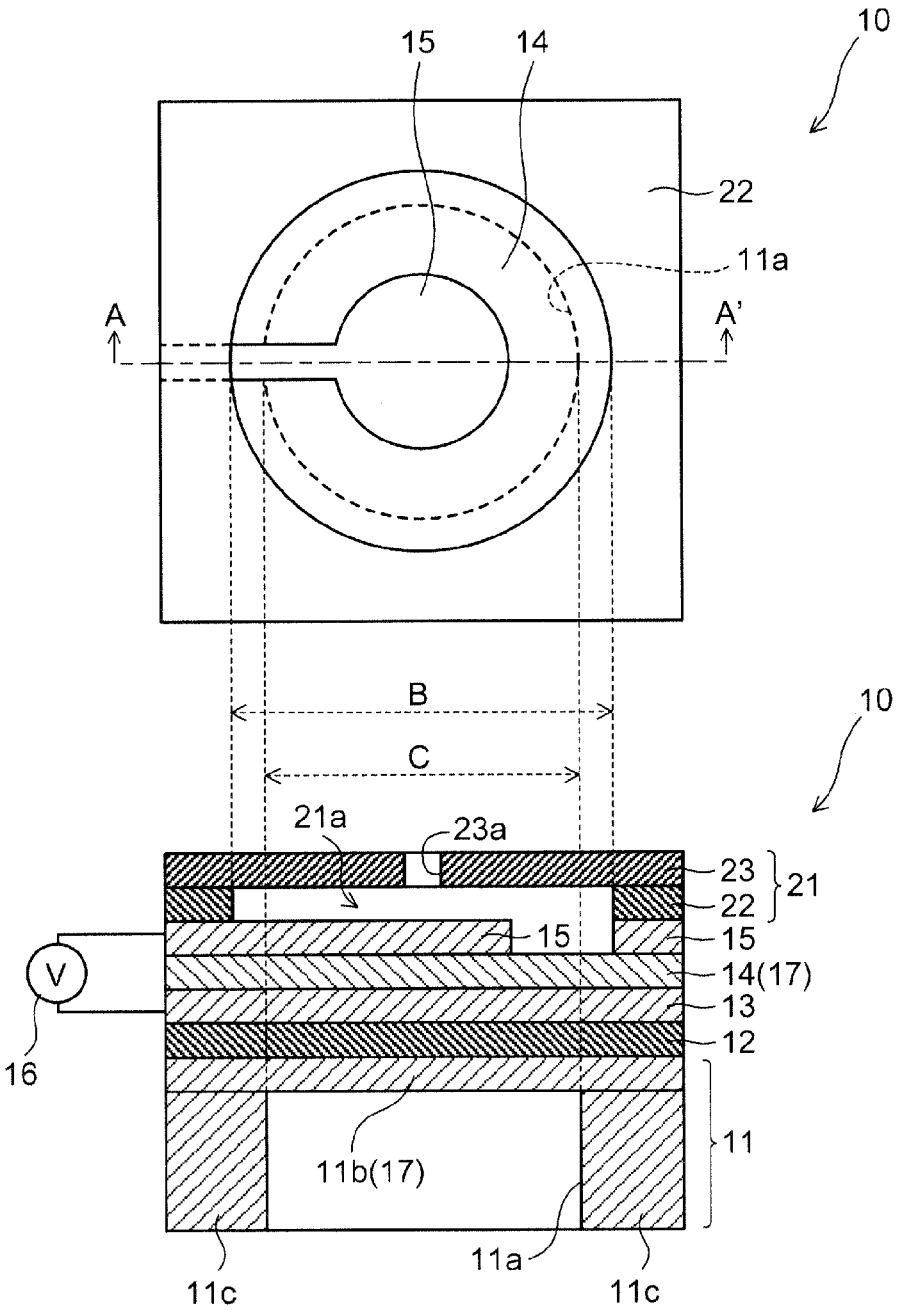
FIG. 2 presents a plan view schematically showing a configuration of one channel of an inkjet head incorporated in the inkjet printer, and a sectional view taken along line A-A' of the plan view and viewed in the direction indicated by the arrows.

Next, a description will be given of a configuration of the inkjet head 10. FIG. 2 presents a plan view schematically showing a configuration of one channel of the inkjet head 10 together with a sectional view taken along line A-A' of the plan view and viewed in the direction indicated by the arrows, for convenience' sake, the nozzle substrate 23 is not illustrated in the plan view of FIG. 2. This way of illustration applies also to the other plan views which will be referred to later.

The inkjet head 10 includes a thermally oxidized film 12, a lower electrode 13, a piezoelectric thin film 14, the upper electrode 15, and an ink discharge portion 21 provided on a substrate 11 in this order.

The substrate 11 is composed of a semiconductor substrate made of a single crystal Si (silicon) alone with a thickness of, for example, 200 to 700 μm (preferably 300 μm or more, in view of its susceptibility to breakage during processing) or an SOI (silicon on insulator) substrate. Note that FIG. 2 shows a case where the substrate 11 is composed of an SOI substrate. An SOI substrate is made of two Si substrates joined together via an oxidized film.

The substrate 11 includes a dug portion 11*a* as a hole or concave portion formed (dug) in its thickness direction, and a driven film 11*b* a part of which in its thickness direction constitutes an upper wall of the dug portion 11*a*, the upper wall being located to a piezoelectric-thin-film-14 side of the dug portion 11*a*. The driven film 11*b* is composed of one of the two Si substrates constituting the SOI substrate, and is connected, at its peripheral portion, with a side wall 11*c* (the other Si substrate constituting the SOI substrate) of the dug portion 11*a* via an oxidized film. The driven film 11*b*, the lower electrode 13, and the thermally oxidized film 12 are operable to be deformed to curve in their thickness directions along with expansion and contraction of the piezoelectric thin film 14 in a direction perpendicular to its thickness direction (that is, a direction parallel to a face of the substrate 11). Along with such curving deformation of the driven film 11*b*, the lower electrode 13, and the thermally oxidized film 12, the piezoelectric thin film 14 also curves in its thickness direction. Thus, it can be said that a displacement film 17 operable to be deformed to curve in its thickness direction is formed by including the piezoelectric thin film 14, the lower electrode 13, the thermally oxidized film 12, and the driven film 11*b*. The substrate 11 supports the displacement film 17 such that the displacement film 17 covers the dug portion 11*a* to allow the displacement film 17 to be operable to be deformed to curve in its thickness direction at an area thereof corresponding to the dug portion 11*a* (an area thereof located over the dug portion 11*a*).

The thermally oxidized film 12 is formed of $SiO_2$ (silicon oxide) having a thickness of about 0.1 μm, for example, for the sake of protection and insulation of the substrate 11.

The lower electrode 13 is composed by stacking a Ti (titanium) layer and a Pt (platinum) layer. The Ti layer is formed to enhance adhesion between the thermally oxidized film 12 and the Pt layer. The Ti layer is about 0.02 μm thick, for example, and the Pt layer is about 0.1 μm thick, for example. The lower electrode 13 is connected to a circuit board 16.

As has been described above, the piezoelectric thin film 14 is a driving film operable to expand and contract in a direction perpendicular to its thickness direction, and is composed of a thin film of PZT (lead zirconate titanate), which is a solid solution of PTO ($PbTiO_3$; lead titanate) and PZO ($PbZrO_3$; lead zirconate). The piezoelectric thin film 14 is 3 to 5 μm thick, for example.

The upper electrode 15 is composed by stacking a Ti layer and a Pt layer. The Ti layer is formed to enhance adhesion between the piezoelectric thin film 14 and the Pt layer. The Ti layer is about 0.02 μm thick, for example, and the Pt layer is about 0.1 to 0.2 μm thick, for example. The upper electrode 15 is formed to be smaller than the piezoelectric thin film 14 in size, and a part of the upper electrode 15 is drawn out along a top surface of the piezoelectric thin film 14 to outside the ink discharge portion 21 to be connected to the circuit board 16. The lower electrode 13 and the upper electrode 15 are disposed so as to sandwich the piezoelectric thin film 14 in its thickness direction.

The ink discharge portion 21 discharges ink to outside itself by having pressure resulting from the curving deformation of the displacement film 17 applied to the ink. The ink discharge portion 21 is disposed on a side opposite to the substrate 11 (the dug portion 11*a*) with respect to the displacement film 17 (in particular, the piezoelectric thin film 14), and the ink discharge portion 21 includes a partition portion 22 and a nozzle substrate 23.

The partition portion 22 is located more to the piezoelectric-thin-film-14 side than the nozzle substrate 23 is, and forms a side wall of an ink chamber 21*a*. That is, the ink chamber 21*a* is formed as a space located inward from the partition portion 22 and closer to the piezoelectric thin film 14 than the nozzle substrate 23 is (a space sandwiched by the nozzle substrate 23 and the piezoelectric thin film 14). In FIG. 2, an opening width B (mm) of the partition portion 22 is illustrated as wider than an opening width C (mm) of the dug portion 11*a* of the substrate 11, but the opening width B and a height (thickness) of the partition portion 22 may be set to arbitrary valises. The nozzle substrate 23 includes a nozzle hole 23*a* through which to discharge ink held inside the ink chamber 21*a* to outside the ink chamber 21*a*.

The partition portion 22 and the nozzle substrate 23 are in direct contact with the ink held in the ink chamber 21*a*, and thus are preferably composed of materials that are highly ink-resistant and also easy to process. Usable as such materials are resin materials such as epoxy-based photosensitive materials, acrylic-based materials, and polyimide-based materials, for example. Besides these materials, metal materials such as iron, copper, nickel. SUS, and the like, glass, ceramic, etc. may be used to form the partition portion 22 and the nozzle substrate 23.

In the above configuration, when a voltage is applied from the circuit board 16 to the lower electrode 13 and the upper electrode 15, the piezoelectric thin film 14 expands and contracts in the direction perpendicular to its thickness direction. Then, curvature is generated in the driven film 11*b* due to the difference in length between the piezoelectric film 14 and the driven film 11*b*, such that the driven film 11*b* is deformed to curve in its thickness direction, and this in turn causes the piezoelectric thin film 14 to be deformed to curve in its thickness direction. Such curving deformation of the displacement film 17 (including the piezoelectric thin film 14 and the driven film 11*b*) generates pressure to be applied to the ink held in the ink chamber 21*a*, and thereby the ink is discharged through the nozzle hole 23*a* to outside the ink chamber 21*a*.

The present embodiment is configured such that the ink discharge portion 21 is provided on a side opposite to the dug portion 11*a* of the substrate 11 with respect to the displacement film 17, and thus is provided independent of the substrate 11, and this configuration makes it possible to design the ink discharge portion 21 independently and regardless of the substrate 11, and to reduce the capacity of the ink chamber 21*a* through such a design.

A substrate is necessary to form a piezoelectric thin film, and in conventional configurations, an ink chamber is formed in such a substrate. To achieve reduced capacity of an ink chamber in such a conventional configuration, it is inevitable to adopt methods such as polishing the substrate in which the ink chamber is formed or transferring a piezoelectric thin film onto the thin substrate in which the ink chamber is formed. However, with the present embodiment where no ink chamber is formed in the substrate 11, it is possible to reduce the capacity of the ink chamber with ease through the independent design of the ink discharge portion 21, without performing substrate polishing or film transfer. This makes it possible to improve the drive frequency of the head to thereby give the inkjet head 10 a high performance. Furthermore, in reducing the capacity of the ink chamber 21*a*, there is no need of performing substrate polishing or film transfer, and thus, the present embodiment is free from such problems (reduction in yield, degradation of performance, damage to films, increase in cost) as have been experienced in cases where substrate polishing or film transfer is performed.

In particular, in configurations where the ink discharge portion 21 includes the nozzle substrate 23 and the partition portion 22 as in the present embodiment, the capacity of the ink chamber 21*a* depends on the opening width B and the thickness (height) of the partition portion 22, because the upper electrode 15 is sufficiently thin. Accordingly, the capacity of the ink chamber 21*a* can be easily reduced by designing to reduce at least one of the opening width B and the height of the partition portion 22.

For example, in the conventional configuration, the ink chamber is sized to have a diameter of 200 μm and a height of 500 μm, but according to the configuration of the present embodiment, it is possible for the ink chamber to be sized to have a diameter of about 250 μm and a height of about 50 μm that is, the capacity of the ink chamber can be reduced to about one-sixth of that of the conventional configuration.

The inkjet head 10 of the present embodiment, which includes the piezoelectric thin film 14 functioning as a driving film, further includes the driven film 11*b* that is operable to be curved along with the expansion and contraction of the piezoelectric thin film. Even with this configuration provided with the driven film 11*b*, it is nonetheless possible to achieve a design for reducing the capacity of the ink chamber 21*a* in the design of the ink discharge portion 21 alone. Thus, even with the configuration provided with the driven film 11*b*, it is possible to reduce the capacity of the ink chamber 21*a* without performing substrate polishing or film transfer, thereby improving the drive frequency of a head. In particular, with the configuration where a part of the substrate 11 in its thickness direction functions as the driven film 11*b* as in the case shown in FIG. 2, there is no need of providing (forming) a driven film aside from the substrate 11. This helps achieve a simple configuration, and with such a simple configuration, the above-described advantages can be achieved.

The present embodiment also employs the piezoelectric thin film 14 as the driving film for discharging ink, and this makes it possible to achieve the above-described advantages with a more compact and lower-cost configuration as compared with cases where ink is discharged by means of the other methods such as the electrostatic method.

The present embodiment is also provided with the upper electrode 15 and the lower electrode 13 disposed so as to sandwich the piezoelectric thin film 14 in its thickness direction, and this makes it possible to cause the piezoelectric thin film 14 to expand and contract in the direction perpendicular to its thickness direction by applying a voltage across the piezoelectric thin film 14 in its thickness direction. Thus, with the configuration where the piezoelectric thin film 14 is driven in this manner, it is possible to achieve the above-described advantages.

Figure 3:
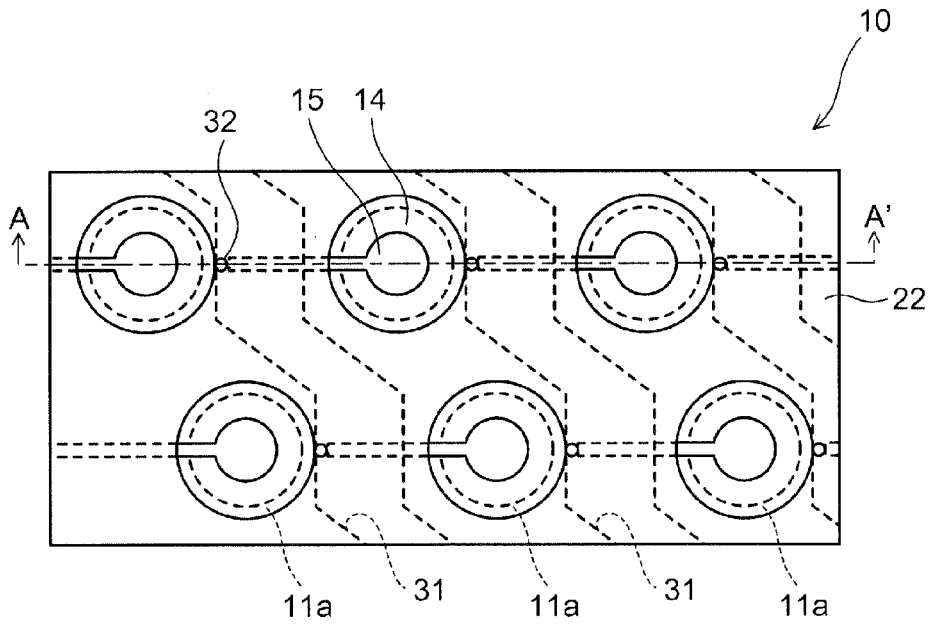
FIG. 3 presents a plan view showing a configuration of a plurality of channels of the inkjet head, and a sectional view taken along line A-A' of the plan view and viewed in the direction indicated by the arrows.
Figure 3:
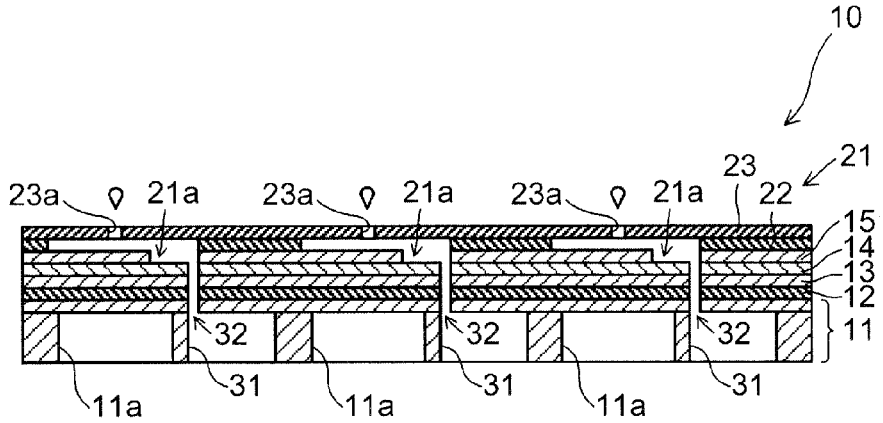

Now, let us refer to FIG. 3, which presents a plan view showing a configuration of a plurality of channels of the above-discussed inkjet head 10 together with a sectional view taken along line A-A' of the plan view and viewed in the direction indicated by the arrows. The substrate 11 may have an ink flow path 31 formed therein through which to supply ink to the ink chamber 21*a*. The ink flow path 31, which communicates with the ink chamber 21*a* via a communication path 32, is connected with an ink storage portion (unillustrated) at a peripheral portion of the head. The ink flow path 31 is shared by a plurality of channels such that ink is supplied through one ink flow path 31 to the ink chamber 21*a* of each of the plurality of channels.

Usually, in an inkjet head, forming an ink flow path on an ink-discharging side (a recording-medium side) becomes a factor that prevents high-density arrangement of ink discharging holes (nozzle holes). In contrast, forming the ink flow path 31 in the substrate 11 that is disposed on a side opposite to the ink discharge portion 21 with respect to the piezoelectric thin film 14 as in the present embodiment makes it possible to arrange nozzle holes 23*a* at a high density on an ink discharging side, and this makes it possible to perform high-resolution image rendering (image formation).

Besides, by forming the ink flow path 31 in the substrate 11 that supports the piezoelectric thin film 14 and the like, it is possible not only to make an effective use of the substrate, and further to form the ink flow path 31 with ease by processing (etching, for example) the substrate 11. Furthermore, since the substrate 11 has a thickness of about 300 to 500 μm, a sufficient capacity of the ink flow path 31 can be secured, and thus, even with one ink flow path 31 formed to communicate with the ink chamber 21*a* of each of the plurality of channels, ink can be securely supplied to the ink chamber 21*a* of each of the plurality of channels.

Figure 4:
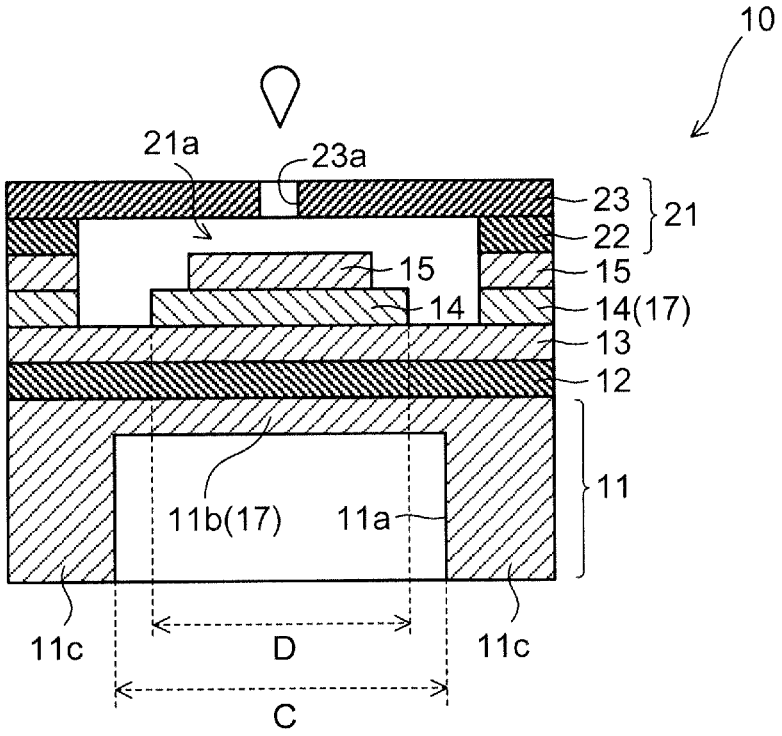
FIG. 4 is a sectional view showing another configuration of the channel.

Another configuration of one channel of the inkjet head 10 is shown in FIG. 4, which is a sectional view. As shown in the figure, it is preferable to form the piezoelectric thin film 14 to be located above the dug portion 11*a* of the substrate 11 (on the ink chamber 21*a* side), with a width D (mm) smaller than the opening width C (mm) of the dug portion 11*a*. That is, it is preferable to remove such an area of the piezoelectric thin film 14 as is located over a border between the dug portion 11*a* and the side wall 11*c*. In this case, the space inward from the partition portion 22 and closer to the piezoelectric thin film 14 than the nozzle substrate 23 is becomes a space sandwiched between the nozzle substrate 23 and the lower electrode 13, and this space constitutes the ink chamber 21*a*. Also, in this configuration, the driven film 11*b* included in the displacement film 17 is supported at the substrate 11 such that the driven film 11*b* covers the dug portion 11*a*.

Here, for the purpose of preventing electrical contact between the upper electrode 15 and the lower electrode 13 from occurring when outwardly drawing out the upper electrode 15, an unillustrated protection film may be formed on the lower electrode 13 at an area where the piezoelectric thin film 14 has been removed, so that the upper electrode 15 can be outwardly drawn out along the surface of the protection film. Alternatively, a part of the piezoelectric thin film 14 may be left so as to stretch over the border, so that the upper electrode 15 can be outwardly drawn out along the surface of the piezoelectric thin film 14.

Thus, by forming the piezoelectric thin film 14 inward from the opening width of the dug portion 11*a*, it is possible to reduce risk of the deformation of the piezoelectric film 14 over the dug portion 11*a* being restrained by the surroundings (for example, the piezoelectric thin film 14 over the side wall 11*c*). This helps increase the displacement of the piezoelectric thin film 14 to improve the output of the head.

Note that, in FIG. 4, the substrate 11 is composed of a single Si substrate, and the dug portion 11*a* is formed by digging the substrate 11 to such a depth that part of the substrate 11 in its thickness direction is left without being dug. In this configuration as well, the upper wall of the dug portion 11*a*, that is, such a part of the substrate 11 in its thickness direction as is located to the piezoelectric thin film 14 side of the dug portion 11*a* constituting the driven film 11*b* that is operable to be curved along with the expansion and contraction of the piezoelectric thin film 14.

Figure 5:
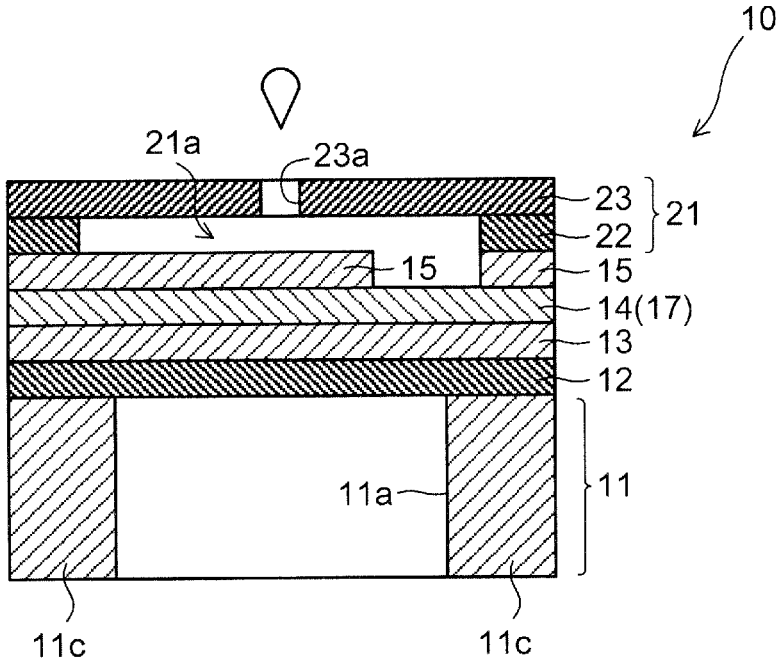
FIG. 5 is a sectional view showing still another configuration of the channel.

Still another configuration of one channel of the inkjet head 10 is shown in FIG. 5, which is a sectional view. The inkjet head 10 may be configured without a driven film as shown in the figure. That is, the inkjet head 10 may be configured such that the displacement film 17 is composed of the piezoelectric thin film 14 as a driving film, the lower electrode 13, and the thermally oxidized film 12, and such that the dug portion 11*a* is formed through the substrate 11 in its thickness direction. With this configuration, an end portion of the piezoelectric thin film 14 is supported on and restrained by the substrate 11 via the thermally oxidized film 12 and the lower electrode 13, and thus, when the piezoelectric thin film 14 is caused to expand and contract in a direction perpendicular to its thickness direction by application of a voltage thereto, the piezoelectric thin film 14 itself is deformed to curve in its thickness direction, and along therewith, the lower electrode 13 and the thermally oxidized film 12 are also deformed to curve, to apply pressure to the ink held in the ink chamber 21*a*. That is, with this configuration, the displacement film 17 is displaced in its thickness direction by the curving deformation of the piezoelectric thin film 14 caused by the expansion and contraction of the piezoelectric thin film 14 itself as a driving film.

With any of the configurations shown in FIGS. 2, 4, and 5, which all make it possible to achieve a design for reducing the capacity of an ink chamber 21*a* by working on the design of the ink discharge portion 21 alone, it is possible to improve the drive frequency of the head by reducing the capacity of the ink chamber 21*a* without performing substrate polishing or film transfer.

In particular, with the configurations shown in FIGS. 4 and 5, it is possible to form an inkjet head without using an SOI substrate as the substrate 11, and the disuse of an SOI substrate results in a lower cost. Further, with the configuration shown in FIG. 5 provided with no driven film, load is reduced due to the absence of the driven film, and the output of the head is accordingly increased.

Note that, in the configuration shown in FIG. 5, the thermally oxidized film 12, which is provided for the sake of protection of the lower electrode 13, is too thin to function as a driven film. However, it is also possible to form the thermally oxidized film 12 thick enough to function as a driven film.

[Method for Producing Inkjet Head]

Figure 6:
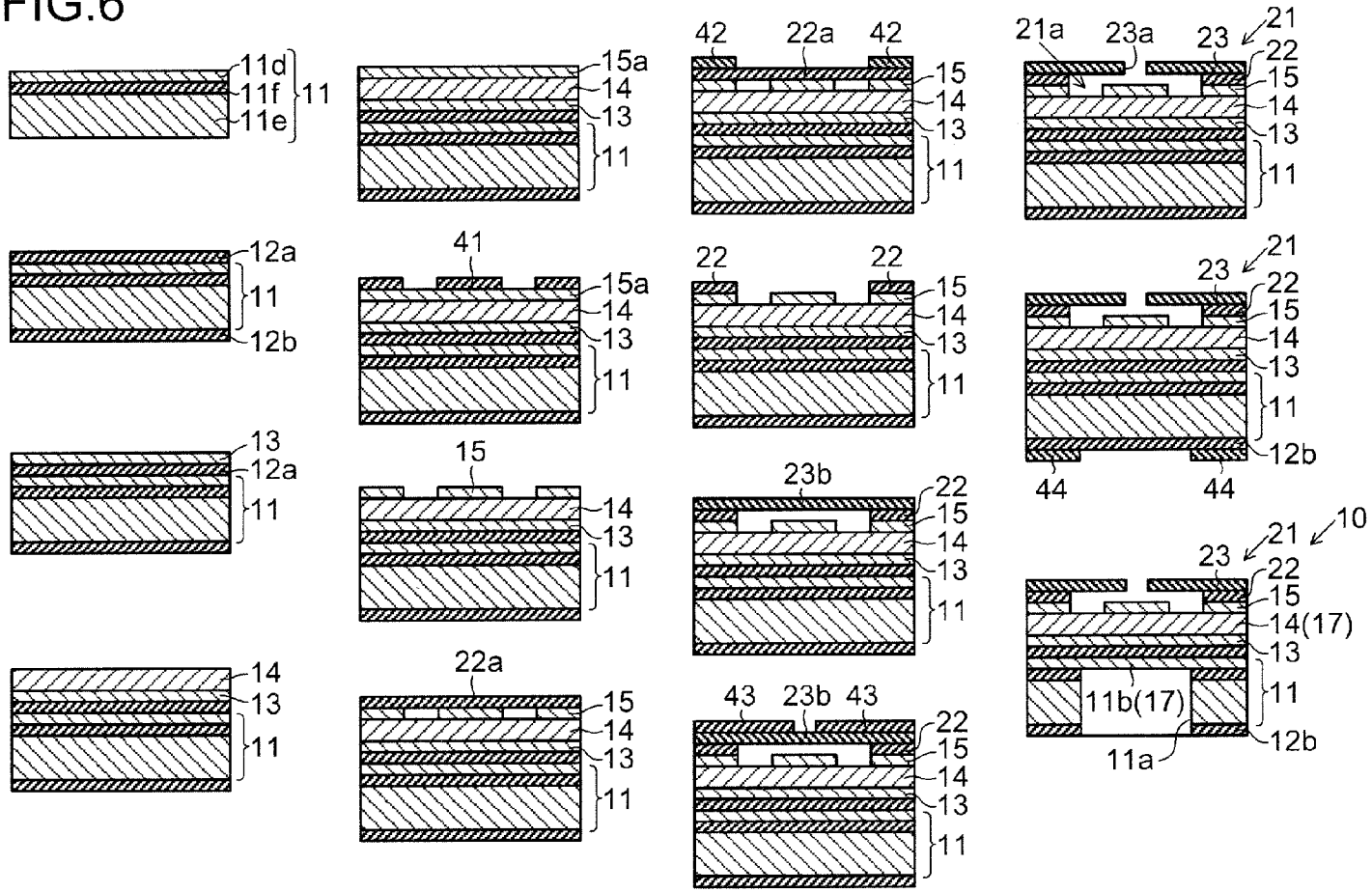
FIG. 6 is a sectional view showing a production process of the inkjet head configured as shown in FIG. 2.

Next, a description will be given below of an example of a method for producing the inkjet head 10 of the present embodiment. A production process of the inkjet head 10 configured as shown in FIG. 2 is illustrated in FIG. 6, which is a sectional view. Note that FIG. 6 shows a section at different stages in the production process, the section being perpendicular to the section taken along line A-A' of FIG. 2, and thus the drawn-out portion of the upper electrode 15 does not appear in the figure. Note also that the production process proceeds in the following order: in FIG. 6, from the top of the left-most column downward to the bottom, then from the top of the second column from the left to the bottom, then from the top of the third column from the left to the bottom, and then from the top of the fourth column from the left to the bottom.

First, the substrate 11 is prepared. As the substrate 11, there can be used a crystalline silicon (Si) substrate, which is widely used in micro electro mechanical systems (MEMS). Used here is a substrate of an SOI structure where two Si substrates 11*d* and 11*e* are joined together via an oxidized film 11*f*. The thickness of the substrate 11*f* is determined by standards, etc., such that a six-inch substrate has a thickness of about 600 μm.

The substrate 11 is placed in a furnace, where temperature is maintained at about 1500° C. for a pre determined period of time, and thereby thermally oxidized films 12*a* and 12*b* made of $SiO_2$ are formed on surfaces of the Si substrates 11*d* and 11*e*, respectively. The thermally oxidized film 12*a* corresponds to the thermally oxidized film 12 shown in FIG. 2. Next, a titanium layer and a platinum layer are formed on the thermally oxidized film 12*a* in this order by the sputtering method, to thereby form the lower electrode 13.

Subsequently, the substrate 11 is heated again to about 600° C. and the piezoelectric thin film 14, which is to function as the driving film, is formed of lead zirconate titanate (PZT) by the sputtering method. Then, a titanium layer and a platinum layer are formed in this order on the piezoelectric thin film 14 to thereby form a layer 15*a* front which the upper electrode 15 is to be formed. Next, a photosensitive resin 41 is applied onto the layer 15*a* by the spin coat method, the photosensitive resin 41 is exposed to light and etched via a mask to thereby remove an unnecessary part thereof, and then the shape of the upper electrode 15 to be formed is transferred onto the photosensitive resin 41. Thereafter, the upper electrode 15 is formed by processing the shape of the layer 15*a* by the reactive ion etching method, using the photosensitive resin 41 as a mask.

Next, a resin film 22*a* (made of an epoxy resin, for example) for forming the partition portion 22 is attached onto the upper electrode 15. The resin film 22*a* has a thickness of about 50 to 200 μm, for example, and the thickness can be selected according to required levels of responsiveness, ink flow-ability, etc. Then, a photosensitive resin 42 is applied to a top surface of the resin film 22*a* by the spin coat method, the photosensitive resin 42 is exposed to light and etched via a mask to thereby remove an unnecessary part thereof, and then the shape of the partition portion 22 to be formed is transferred onto the photosensitive resin 42. Thereafter, the resin film 22*a* is subjected to removing processing using the solvent etching method, with the photosensitive resin 42 as a mask, and thereby the partition portion 22 is formed.

Next, a resin film 23*b* (made of an epoxy resin, for example) for forming the nozzle substrate 23 is attached to a top surface of the partition portion 22. The resin film 23*b* has a thickness of about 5 to 20 μm, for example, and the thickness can be selected according to a required droplet amount and a required droplet speed. Then, a photosensitive resin 43 is applied to a top surface of the resin film 23*b* by the spin coat method, the photosensitive resin 43 is exposed to light and etched via a mask to thereby remove an unnecessary part thereof, and then the shape of the nozzle hole 23*a* to be formed is transferred onto the photosensitive resin 43. Thereafter, the resin film 23*b* is subjected to removing processing using the solvent etching method, with the photosensitive resin 43 as a mask, and thereby the nozzle substrate 23 having the nozzle hole 23*a* is formed. A space inside the partition portion 22 and located closer to the piezoelectric film 14 than the nozzle substrate 23 is will function as the ink chamber 21*a*, and through this production process, the ink discharge portion 21 including the ink chamber 21*a* as described above is formed on a side opposite to the substrate 11 with respect to the piezoelectric thin film 14.

Here, it is also possible to use photosensitive resin films as materials of the partition portion 22 and the nozzle substrate 23 such that the photosensitive resin films serve also as the above-described photosensitive resins 42 and 43. It is also possible to attach thin films made of metal, glass, ceramic, and the like besides the resin films and process the thin films into the shapes of the partition portion 22 and the nozzle substrate 23. It is also possible to process thin films of resin, metal, glass, ceramic, and the like into the shapes of the partition portion 22 and the nozzle substrate 23 in advance, and attach the thus processed thin film.

Then, a photosensitive resin 44 is applied to a rear surface of the substrate 11 (that is, on the thermally oxidized film 12*b*) by the spin coat method, the photosensitive resin 44 is exposed to light and etched via a mask to thereby remove an unnecessary part thereof, and then the shape of the dug portion 11*a* and the ink flow path to be formed are transferred onto the photosensitive resin 44. Thereafter, the substrate 11 is subjected to removing processing using the reactive ion etching method, with the photosensitive resin 44 as a mask, and thereby the dug portion 11*a*, etc. are formed. That is, the dug portion 11*a* is formed by digging the substrate 11 from a side opposite to the side where the piezoelectric thin film 14 is formed. At this time, by forming the dug portion 11*a* such that a part (the Si substrate 11*d*) of the substrate 11 in its thickness direction is left without being dug, the driven film 11*b* constituted by the Si substrate 11*d* is formed, and the displacement film 17 (including the piezoelectric thin film 14 and the driven film 11*b*), which is operable to be deformed to curve in its thickness direction at its area corresponding to the dug portion 11*a* by expansion and contraction of the piezoelectric thin film 14, is supported at the substrate 11 so as to cover the dug portion 11*a*. This completes the production of the inkjet head 10.

Figure 7:
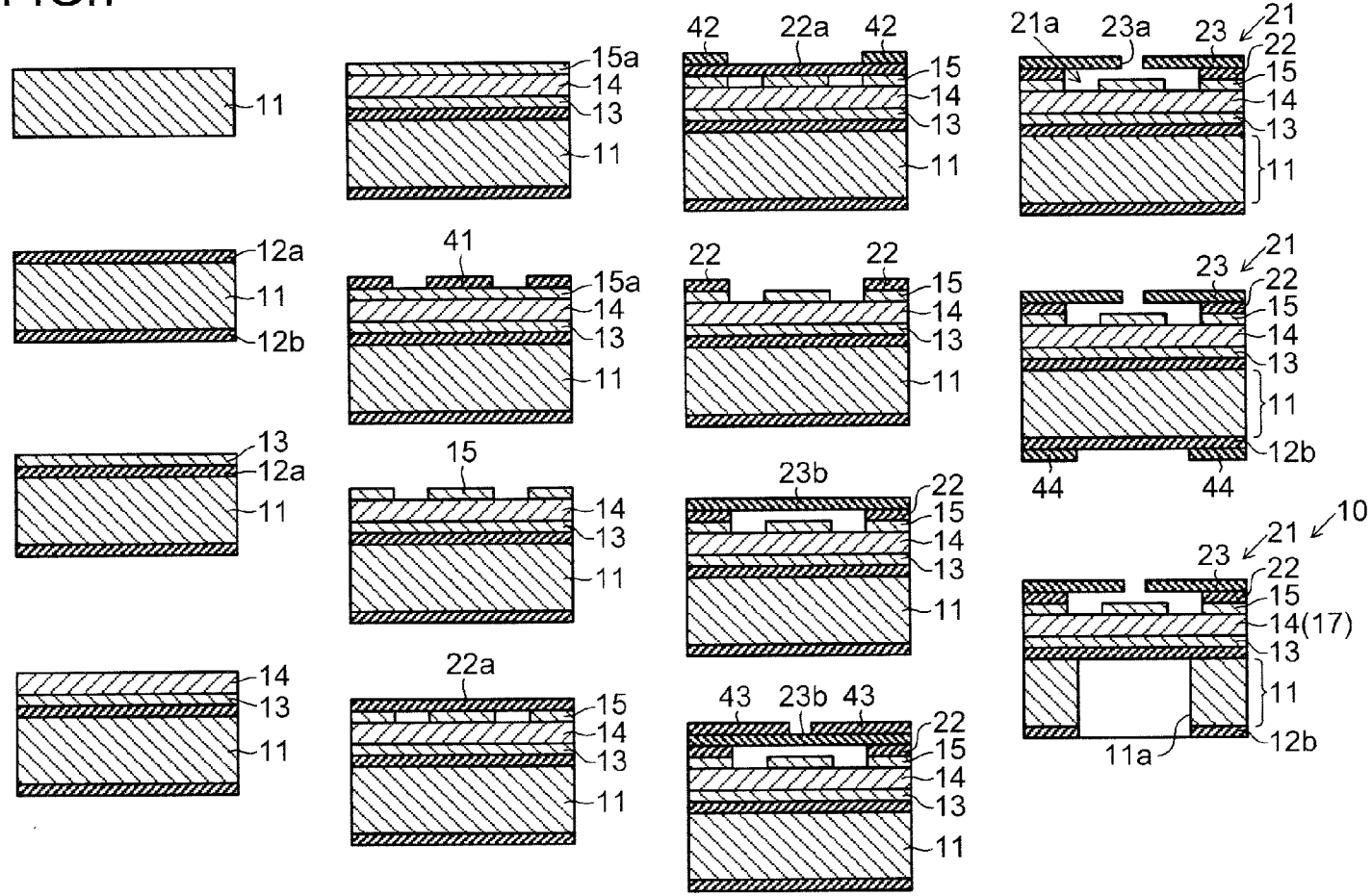
FIG. 7 is a sectional view showing a production process of the inkjet head configured as shown in FIG. 5.
Figure 8:
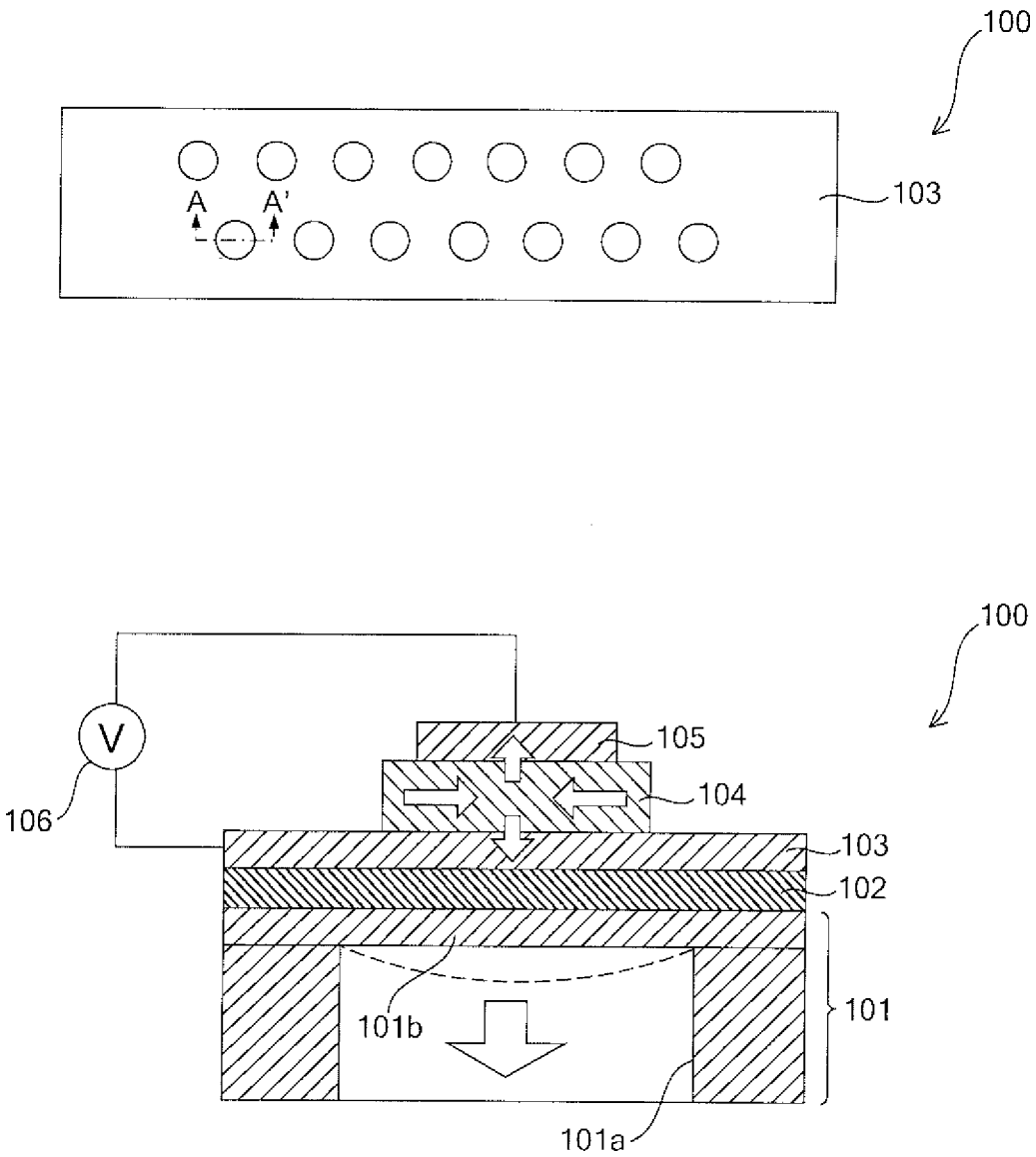
FIG. 8 (PRIOR ART)
FIG. 8 presents a plan view schematically showing a configuration of a conventional actuator using a piezoelectric thin film and a sectional view taken along line A-A' of the plan view and viewed in the direction indicated by the arrows.
Figure 9:
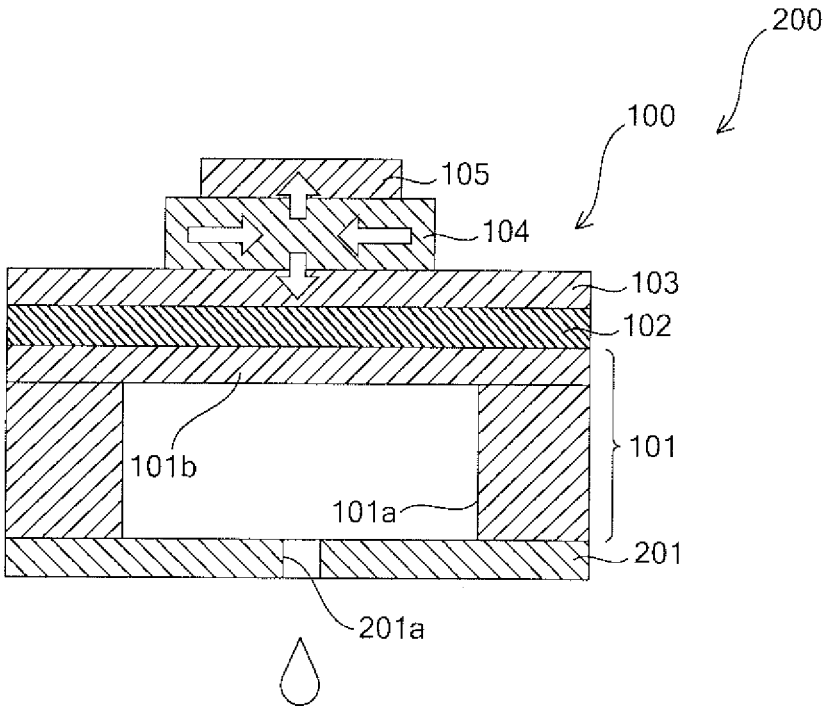
FIG. 9 (PRIOR ART)
FIG. 9 is a sectional view schematically showing a configuration of a channel including the conventional actuator.

A production process of the inkjet head 10 configured as shown in FIG. 5 is illustrated in FIG. 7, which is a sectional view. As for production of the inkjet head 10 without a driven film, the inkjet head 10 of such a type can be produced through the same production process as shown in FIG. 6, except that a common (single) Si substrate is used as the substrate 11. In the production process, the inkjet head 10 without a driven film can be obtained by forming the dug portion 11*a* by digging through the substrate 11 in its thickness direction in the last digging step.

As has been discussed above, the production method of the inkjet head 11 of the present embodiment includes the steps of forming the piezoelectric thin film 14 as the driving film at the substrate 11; forming the dug portion 11*a* by digging the substrate 11 from a side opposite to the side where the piezoelectric thin film 14 is formed, and supporting the displacement film 17 including the piezoelectric thin film 14 such that the displacement film 17 covers the dug portion 11*a* so as to allow expansion and contraction of the piezoelectric thin film 14 in a direction perpendicular to its thickness direction to cause curving deformation of the displacement film 17 in its thickness direction in its area corresponding to the dug portion 11*a*; and forming the ink discharge portion 21, through which ink held in the ink chamber 21*a* is discharged to outside the ink chamber 21*a* by the curving deformation of the displacement film 17, on a side opposite to the dug portion 11*a* of the substrate 11 with respect to the displacement film 17.

Thus, by forming the ink discharge portion 21 independently of the substrate 11, it is possible to design the ink discharge portion 21 alone so as to reduce the capacity of the ink chamber 21*a*. Such a design makes it possible to reduce the capacity of the ink chamber 21*a* to thereby improve the drive frequency of the head, without performing substrate polishing or film transfer.

It can be said that the inkjet head, the method for producing the same, and the inkjet printer of the present embodiment discussed above may also be described as follows.

An inkjet head of the present embodiment includes a displacement film that includes a driving film operable to expand and contract in a direction perpendicular to its thickness direction, the displacement film being operable to undergo curving deformation in its thickness direction, a substrate that includes a hole portion formed therein in its thickness direction and that supports the displacement film such that the displacement film covers the hole portion so as to allow expansion and contraction of the driving film to cause the curving deformation of the displacement film in its thickness direction in its area corresponding to the hole portion, and an ink discharge portion that includes an ink chamber holding ink and that discharges the ink to outside the ink discharge portion by having pressure resulting from the curving deformation of the displacement film applied to the ink. Here, the ink discharge portion may be disposed on a side opposite to the hole portion of the substrate with respect to the displacement film.

Another inkjet head according, to the present embodiment includes a displacement film that includes a driving film operable to expand and contract in the direction perpendicular to its thickness direction, the displacement film being operable to undergo curving deformation in its thickness direction, a substrate that includes a dug portion dug therethrough in its thickness direction and that supports the displacement film such that the displacement film covers the dug portion so as to allow expansion and contraction of the driving film to cause the curving deformation of the displacement film in its thickness direction in its area corresponding to the dug portion, and an ink discharge portion that includes an ink chamber holding ink and that discharges the ink to outside the ink discharge portion by having pressure resulting from the curving deformation of the displacement film applied to the ink. Here, the ink discharge portion may be disposed on a side opposite to the dug portion of the substrate with respect to the displacement film.

According to the above configurations, the ink discharge portion having the ink chamber is disposed on the side opposite to the hole portion (dug portion) of the substrate with respect to the displacement film including the driving film. Ink is discharged to outside the ink discharge portion by having pressure resulting from the curving deformation of the displacement film applied to the ink. The curving deformation of the displacement film is achieved by the driving film expanding and contracting in the direction perpendicular to the thickness direction thereof in a state where the displacement film is supported at the substrate so as to cover the hole portion (the dug portion).

As described above, the ink discharge portion is disposed on the side opposite to the hole portion (the dug portion) of the substrate with respect to the displacement film, that is, the ink discharge portion is provided independently of the substrate. This helps achieve a design for reducing the capacity of the ink chamber regardless of the substrate (working on the design of the ink discharge portion alone), by reducing the height of the ink discharge portion, for example. This makes it possible to improve (increase) the drive frequency of the head by reducing the capacity of the ink chamber without polishing the substrate or transferring the films. Furthermore, in reducing the capacity of the ink chamber, there is no need of performing substrate polishing or film transfer, and thus, the present invention is free from such disadvantages (reduction in yield, degradation of performance, damage to films, increase in cost) as have been suffered in cases where substrate polishing or film transfer is performed.

The ink discharge portion may further include a nozzle substrate that includes a nozzle hole through which to discharge the ink and a partition portion that is located closer to the displacement film than the nozzle substrate is and forms the side wall of the ink chamber.

With this configuration, it is possible to reduce the capacity of the ink chamber located closer to the displacement film than the nozzle substrate is, by means of a design where the height or the opening width (inner diameter) of the partition portion is reduced.

The displacement film may further include a driven film that is operable to curve in its thickness direction along with the expansion and contraction of the driving film.

Even with such a configuration where the displacement film includes the driven film in addition to the driving film as described above, it is nonetheless possible to achieve a design for reducing the capacity of the ink chamber by working on the design of the ink discharge portion alone. Consequently, even with the configuration where the displacement film includes the driven film, it is possible to reduce the capacity of an ink chamber without performing substrate polishing or film transfer.

The driven film may be composed of such a part of the substrate in its thickness direction as constitutes a wall located to a driving-film side of the hole portion. Alternatively, the driven film may be composed of such a part of the substrate in its thickness direction as constitutes an upper wall of the dug portion. In either of these cases, as compared with a case where the driven film is provided aside from the substrate, it is possible to make the configuration simpler, and with such a simple configuration, it is possible to achieve the above-described advantages.

The displacement film may be operable to be displaced in its thickness direction by the driving film being deformed to curve in its thickness direction by the expansion and contraction of the driving film itself. Even with a configuration where the displacement film does not include a driven film, it is nonetheless possible to achieve a design for reducing the capacity of the ink chamber by working on the design of the ink discharge portion alone. Thus, even with the above configuration, it is possible to improve the drive frequency of the head by reducing the capacity of the ink chamber without performing substrate polishing or film transfer.

The displacement film is preferably a piezoelectric thin film. In this case, the above-described advantages can be achieved with a compact and low-cost configuration using the piezoelectric thin film.

The above-described inkjet head may further include upper and lower electrodes disposed so as to sandwich the piezoelectric thin film in its thickness direction to apply a voltage across the piezoelectric thin film. In this case, it is possible to apply a voltage across the piezoelectric thin film in its thickness direction to thereby cause the piezoelectric thin film to displace (expand and contract) in a direction perpendicular to its thickness direction, and with such a configuration, it is possible to achieve the above-described advantages.

The substrate preferably has an ink flow path formed therein through which to supply ink to the ink chamber. The formation of the ink flow path in the substrate that is disposed opposite to the ink discharge portion with respect to the displacement film makes it easy to form discharge holes on the ink discharging side at a high density, which makes it possible to perform high-resolution image rendering.

An inkjet printer of the present embodiment includes the inkjet head configured as described above. Thereby, a high-performance inkjet printer with improved printing speed and resolution can be realized.

A method for producing the inkjet head of the present embodiment may include the steps of: forming a driving film at a substrate; forming a dug portion by digging the substrate from a side opposite to the side where the driving film is formed, and supporting a displacement film including the driving film such that the displacement film covers the dug portion so as to allow expansion and contraction of the driving film in a direction perpendicular to its thickness direction to cause curving deformation of the displacement film in its thickness direction in its area corresponding to the dug portion; and forming an ink discharge portion, through which ink held in the ink chamber is discharged to outside the ink chamber by the curving deformation of the displacement film, on a side opposite to the dug portion of the substrate with respect to the displacement film. This makes it possible to improve the drive frequency of the head by reducing the capacity of the ink chamber by working on the design of the ink discharge portion alone, without performing substrate polishing or film transfer.

Alternatively, a method for producing the inkjet head of the present embodiment may include the steps of: forming a driving film on a substrate; forming a hole portion in the substrate on a side opposite to a side where the driving film is formed, and supporting a displacement film including the driving film such that the displacement film covers the hole portion so as to allow expansion and contraction of the driving film in a direction perpendicular to its thickness direction to cause curving deformation of the displacement film in its thickness direction in its area corresponding to the hole portion; and forming an ink discharge portion, through which ink held in the ink chamber is discharged to outside the ink chamber by the curving deformation of the displacement film, on a side opposite to the hole portion of the substrate with respect to the displacement film. In this case as well, the same advantages as described above can be obtained.

INDUSTRIAL APPLICABILITY

The inkjet head of the present invention is usable in inkjet printers.

LIST OF REFERENCE SIGNS

1 inkjet printer
10 inkjet head
11 substrate
11*a* dug portion (hole portion)
11*b* driven film
13 lower electrode
14 piezoelectric thin film (driving film)
15 upper electrode
17 displacement film
21 ink discharge portion
21*a* ink chamber
22 partition portion
23 nozzle substrate
23*a* nozzle hole
31 ink flow path

The invention claimed is:

1. An inkjet head comprising:

a displacement film comprising a driving film operable to expand and contract in a direction perpendicular to a thickness direction of the driving film, the displacement film being operable to undergo a curving deformation in a thickness direction of the displacement film;

a substrate comprising a hole portion formed therein in a thickness direction thereof and that supports the displacement film such that the displacement film covers the hole portion so as to allow expansion and contraction of the driving film to cause the curving deformation of the displacement film in the thickness direction of the displacement film in an area of the displacement film corresponding to the hole portion;

an ink discharge portion comprising an ink chamber holding ink and that discharges the ink to outside of the ink discharge portion by having pressure resulting from the curving deformation of the displacement film applied to the ink, wherein the ink discharge portion is disposed on a side opposite to the hole portion of the substrate with respect to the displacement film;

an upper electrode; and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber; and wherein the displacement film further comprises a driven film that is operable to curve in a thickness direction of the driven film along with the expansion and contraction of the driving film; and wherein the driven film comprises such a part of the substrate in a thickness direction of the substrate as constitutes a wall located to a driving-film side of the hole portion.

2. The inkjet head according to claim 1, wherein the ink discharge portion comprises a nozzle substrate comprising a nozzle hole through which to discharge the ink and a partition portion disposed closer to the displacement film than the nozzle substrate is and constituting a side wall of the ink chamber.

3. The inkjet head according to claim 1, wherein the driving film is a piezoelectric thin film.

4. The inkjet head according to claim 1, wherein the substrate has an ink flow path formed therein through which to supply ink to the ink chamber.

5. An inkjet printer comprising:

a housing;

a carriage movable with respect to the housing; and an inkjet head mounted to the carriage, wherein the inkjet head comprises:

a displacement film comprising a driving film operable to expand and contract in a direction perpendicular to a thickness direction of the driving film, the displacement film being operable to undergo a curving deformation in a thickness direction of the displacement film;

a substrate comprising a hole portion formed therein in a thickness direction thereof and that supports the displacement film such that the displacement film covers the hole portion so as to allow expansion and contraction of the driving film to cause the curving deformation of the displacement film in the thickness direction of the displacement film in an area of the displacement film corresponding to the hole portion;

an ink discharge portion comprising an ink chamber holding ink and that discharges the ink to outside of the ink discharge portion by having pressure resulting from the curving deformation of the displacement film applied to the ink, wherein the ink discharge portion is disposed on a side opposite to the hole portion of the substrate with respect to the displacement film;

an upper electrode; and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber; and wherein the displacement film further comprises a driven film that is operable to curve in a thickness direction of the driven film along with the expansion and contraction of the driving film; and wherein the driven film comprises such a part of the substrate in a thickness direction of the substrate as constitutes a wall located to a driving-film side of the hole portion.

6. A method for producing an inkjet head, the method comprising:

forming a driving film at a substrate;

forming a hole portion in the substrate, on a side opposite to a side where the driving film is formed, and supporting a displacement film including the driving film such that the displacement film covers the hole portion so as to allow expansion and contraction of the driving film in a direction perpendicular to a thickness direction of the driving film to cause a curving deformation of the displacement film in a thickness direction of the displacement film in an area of the displacement film corresponding to the hole portion;

forming an ink discharge portion, through which ink held in a ink chamber is discharged to outside of the ink chamber by the curving deformation of the displacement film, on a side opposite to the hole portion of the substrate with respect to the displacement film; and forming an upper electrode and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber.

7. An inkjet head comprising:

a displacement film comprising a driving film operable to expand and contract in a direction perpendicular to a thickness direction of the driving film, the displacement film being operable to undergo a curving deformation in a thickness direction of the displacement film;

a substrate comprising a hole portion formed therein in a thickness direction thereof and that supports the displacement film such that the displacement film covers the hole portion so as to allow expansion and contraction of the driving film to cause the curving deformation of the displacement film in the thickness direction of the displacement film in an area of the displacement film corresponding to the hole portion; and an ink discharge portion comprising an ink chamber holding ink and that discharges the ink to outside of the ink discharge portion by having pressure resulting from the curving deformation of the displacement film applied to the ink, wherein the ink discharge portion is disposed on a side opposite to the hole portion of the substrate with respect to the displacement film;

an upper electrode; and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber; and wherein the substrate has an ink flow path formed therein through which to supply ink to the ink chamber.

8. The inkjet head according to claim 7, wherein the ink discharge portion comprises a nozzle substrate including a nozzle hole through which to discharge the ink and a partition portion disposed closer to the displacement film than the nozzle substrate is and constituting a side wall of the ink chamber.

9. The inkjet head according to claim 7, wherein the displacement film further comprises a driven film that is operable to curve in a thickness direction of the driven film along with the expansion and contraction of the driving film.

10. The inkjet head according to claim 9, wherein the driven film is composed of such a part of the substrate in a thickness direction of the substrate as constitutes a wall located to a driving-film side of the hole portion.

11. The inkjet head according to claim 7, wherein the displacement film is operable to be displaced in the thickness direction of the displacement film by curving deformation of the driving film in the thickness direction caused by the expansion and contraction of the driving film itself.

12. The inkjet head according to claim 7, wherein the driving film is a piezoelectric thin film.

13. An inkjet printer comprising:

a housing;

a carriage movable with respect to the housing; and an inkjet head mounted to the carriage, wherein the inkjet head comprises:

a displacement film comprising a driving film operable to expand and contract in a direction perpendicular to a thickness direction of the driving film, the displacement film being operable to undergo a curving deformation in a thickness direction of the displacement film;

a substrate comprising a hole portion formed therein in a thickness direction thereof and that supports the displacement film such that the displacement film covers the hole portion so as to allow expansion and contraction of the driving film to cause the curving deformation of the displacement film in the thickness direction of the displacement film in an area of the displacement film corresponding to the hole portion;

an ink discharge portion comprising an ink chamber holding ink and that discharges the ink to outside of the ink discharge portion by having pressure resulting from the curving deformation of the displacement film applied to the ink, wherein the ink discharge portion is disposed on a side opposite to the hole portion of the substrate with respect to the displacement film;

an upper electrode; and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber; and wherein the substrate has an ink flow path formed therein through which to supply ink to the ink chamber.

14. A method for producing an inkjet head, the method comprising:

forming a driving film at a substrate;

forming a hole portion in the substrate, on a side opposite to a side where the driving film is formed, and supporting a displacement film including the driving film such that the displacement film covers the hole portion so as to allow expansion and contraction of the driving film in a direction perpendicular to a thickness direction of the driving film to cause a curving deformation of the displacement film in a thickness direction of the displacement film in an area of the displacement film corresponding to the hole portion;

forming an ink discharge portion, through which ink held in an ink chamber is discharged to outside of the ink chamber by the curving deformation of the displacement film, on a side opposite to the hole portion of the substrate with respect to the displacement film;

forming an ink flow path within the substrate, wherein ink is supplied to the ink chamber by the ink flow path; and forming an upper electrode and a lower electrode, wherein the driving film is sandwiched between the upper electrode and the lower electrode in a thickness direction of the driving film so that the upper electrode and the lower electrode apply a voltage across the driving film, wherein the lower electrode is positioned closer to a side of the substrate than the upper electrode and the driving film, and the upper electrode is exposed to an interior of the ink chamber.

* * * * *